US006033306A

United States Patent [19]

De Souza

[11] Patent Number: 6,033,306

[45] Date of Patent: Mar. 7, 2000

[54] GAME OF CHANCE

[76] Inventor: Oswald De Souza, Avenida Oswaldo Cruz 149/Apt. 302, Flamengo-Rio De Janeiro-RJ, Brazil, CEP:22250-060

[21] Appl. No.: 08/859,607

[22] Filed: May 20, 1997

Related U.S. Application Data

[60] Provisional application No. 60/018,062, May 21, 1996.

[51] Int. Cl.[7] ..... A63F 3/06

[52] U.S. Cl. ..... 463/18; 463/25; 273/139

[58] Field of Search ..... 463/16, 17, 18, 463/19, 25; 273/269, 237, 236, 274, 138.1, 138.2, 139

[56] References Cited

U.S. PATENT DOCUMENTS

| | | | |
|---|---|---|---|
| 5,154,420 | 10/1992 | Gutknecht | 463/17 |
| 5,269,523 | 12/1993 | Boylan et al. | 273/138 R |
| 5,830,063 | 11/1998 | Byrne | 463/18 |
| 5,833,538 | 11/1998 | Weiss | 463/25 |
| 5,909,875 | 6/1999 | Weingardt | 273/269 |

*Primary Examiner*—Valencia Martin-Wallace
*Assistant Examiner*—John Paradiso
*Attorney, Agent, or Firm*—Darby & Darby

[57] ABSTRACT

A game of chance is provided wherein a participant may choose a selectable number of codes from a library of codes. In accordance with a computer controlled preferred embodiment, the participant may select the number of codes on a video display screen and may then select that number of codes from among the library. The computer then randomly selects a predetermined number of codes from those in the library as winning codes. The participant is then awarded a payout, based upon the number of codes in his selective group that match winning codes. The agency operating the game is also able to select the particular numbers that will be winners, the frequency of number matches, and the excitement, while also being able to control the payout rate independently. In an alternate embodiment, the player selects a fixed number of wagers and is able to control the number of codes selected by the computer. Again, payouts are made on the basis of matches between the players selections and the computer selections.

25 Claims, 14 Drawing Sheets

GAME OF CHANCE

This patent application claims the priority of U.S. Provisional Application No. 60/018,062 filed May 21, 1996.

FIELD OF THE INVENTION

The present invention relates generally to games and amusements and, more particularly, concerns a game of chance and a method for playing the same.

BACKGROUND OF THE INVENTION

Games of chance abound in modern life. Not only are an increasing number of jurisdictions legalizing gambling and casinos, but many states are themselves sponsoring and managing various types of games of chance, such as lotteries. Moreover, such games are generally received enthusiastically by the public and enjoy wide participation.

However, existing games of chance fit into a very small group of different game types which are, by now, well-known to the public and, therefore, suffer from the inability to retain the interest of the participating public over the long term. In addition, they are quite limited in the control they give the supervisory agency which provides the game in managing the appeal and profitability of the game.

Ideally, a game of chance should exhibit a number of desirable characteristics. First of all, it should offer at least one huge prize or "jackpot." Secondly, the game should be easy to understand and easy to play. In addition, it should offer the impression to the participant that winning is easy. it should also confirm this impression by providing frequent successes and wins, even if minor ones. Also, the game should offer emotion, excitement and suspense to the participant. Finally, even if the participant does not win, it should appear that not winning was a near miss.

From the point of view of the agency that manages the game, it should be possible to control the success rate of participants and the profitability of the game. Moreover, it should be possible to control the apparent success rate, without compromising profitability.

In accordance with the present invention, a game of chance is provided wherein a participant may choose a selectable number of codes from a library of codes. In accordance with a computer controlled preferred embodiment, the participant may select the number of codes he will bet on a video display screen and may then select that number of codes from among the library. The computer then randomly selects a predetermined number of codes from those in the library as winning codes. The participant is awarded a payout, based upon the number of codes in his selected group that match winning codes. The agency operating the game is also able to select the particular number of matches that will be winners and the payout for each win, the frequency of occurrence of different numbers of matches, and the excitement, while also being able to control the total payout rate of the game independently. In an alternate embodiment, the player selects a fixed number of wagers and is able to control the number of codes selected by the computer. Again, payouts are made on the basis of the number matches between the player's selections and the computer selections.

BRIEF DESCRIPTION OF THE DRAWINGS

The foregoing brief description, as well as further objects, features and advantages of the present invention will be understood more completely from the following detailed description of presently preferred embodiments, with reference being had to the accompanying drawings, in which.

DETAILED DESCRIPTION OF THE PREFERRED EMBODIMENTS

In accordance with the preferred embodiment of the present invention, there is provided a video form of a game of chance programmed to run under Microsoft Windows®. The game has two modes of operation, a preferred "direct" mode and an alternate "reverse" mode. Those skilled in the art will appreciate that the game need not be designed to run on a general purpose computer, but could be designed as a stand alone unit with a special purpose computer with programming in hardware, software or firmware form. Also, those skilled in the art will appreciate that the presentation of the game provided herein is only a basic one and illustrative. In a true gaming environment, it would be likely that video and audio enhancements would be added and the overall presentation changed to increase the appeal to the user.

Figure 1:
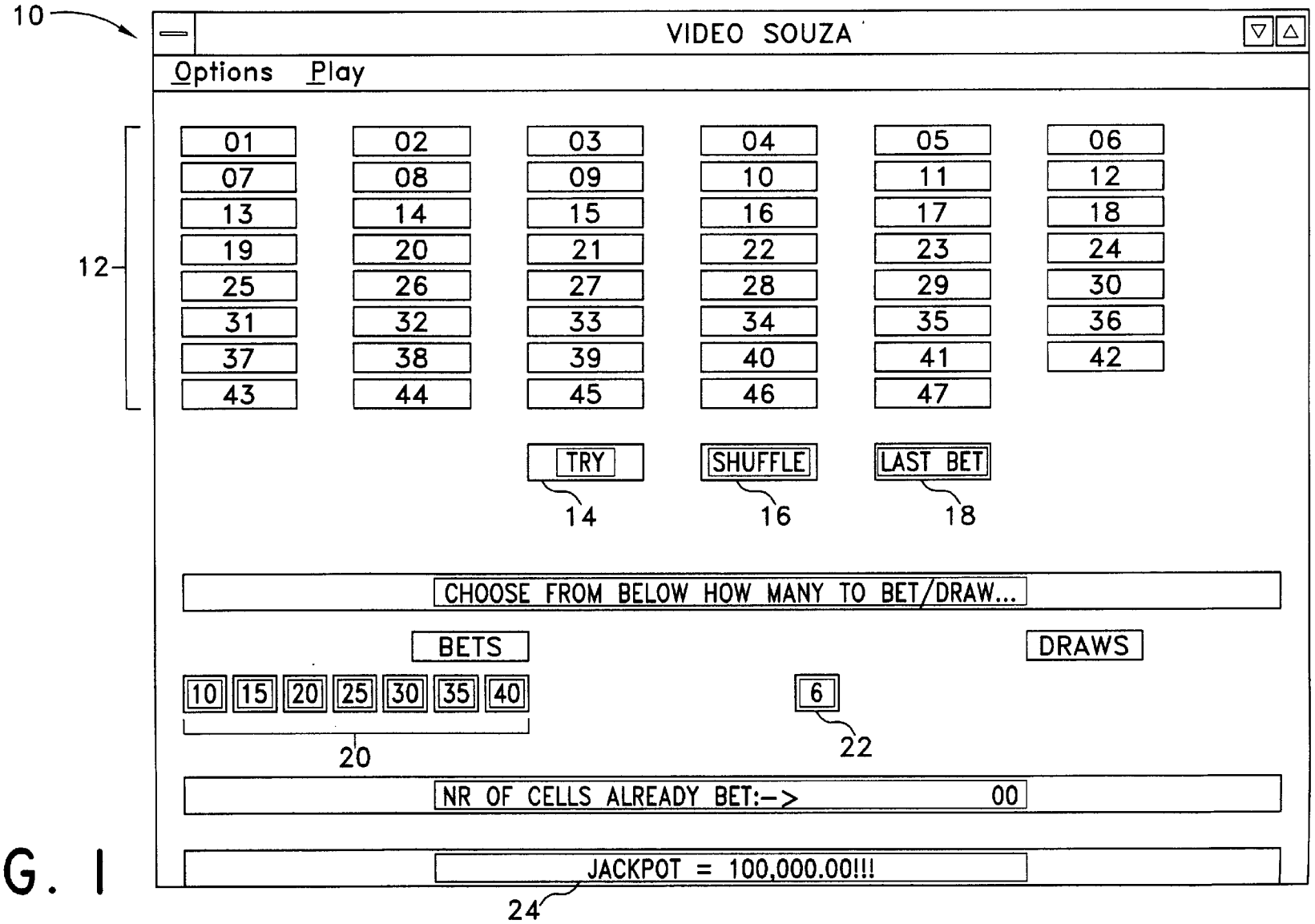
FIG. 1 is a gray scale screen print illustrating a screen of a preferred embodiment of the invention in the form of a video game.

Turning now to FIG. 1, there is presented a gray scale representation of the primary player's screen of the preferred mode of the game. The name of the game is VIDEO SOUZA™. Although two options appear in the menu in the upper left-hand corner ("Options" and "Play"), these are only available to the system operator, and a player is presented with the screen shown, which represents the "Play" option. The "Options" screen will be discussed further below.

In the top half of the screen 10, there is provided a plurality of wager selection blocks 12, each of which contains a number from "01" to "47", which constitutes the entire set of available codes for the preferred embodiment. Both the player and the machine (computer) make their selections of code words from among these blocks. In the case of the player, he selects a particular number or code by clicking on the corresponding box with his mouse or similar pointing device.

Immediately below the code blocks 12, there are provides operation selection blocks 14, 16 and 18. The user selects these blocks by clicking on them with his mouse. If he clicks on block 16 ("SHUFFLE"), the computer will randomly select for him the number of codes he wishes to play. If he clicks on block 18 ("LAST BET"), the computer will simply repeat his last bet. After the user has selected all of his blocks, he clicks on block 14 ("TRY"), at which point the computer takes control, making its selection, reporting the number of matches, and reporting any payouts to which the player is entitled.

In the bottom portion of the screen, the user selects the number of wagers which he will make by clicking on one of the boxes 20 which indicates that number of wagers. As indicated by block 22, the computer will draw a fixed number (6) of codes. The bottom of screen 10 indicates the value of the jackpot within block 24 as a multiple of the amount of the player's wager.

Figure 2:
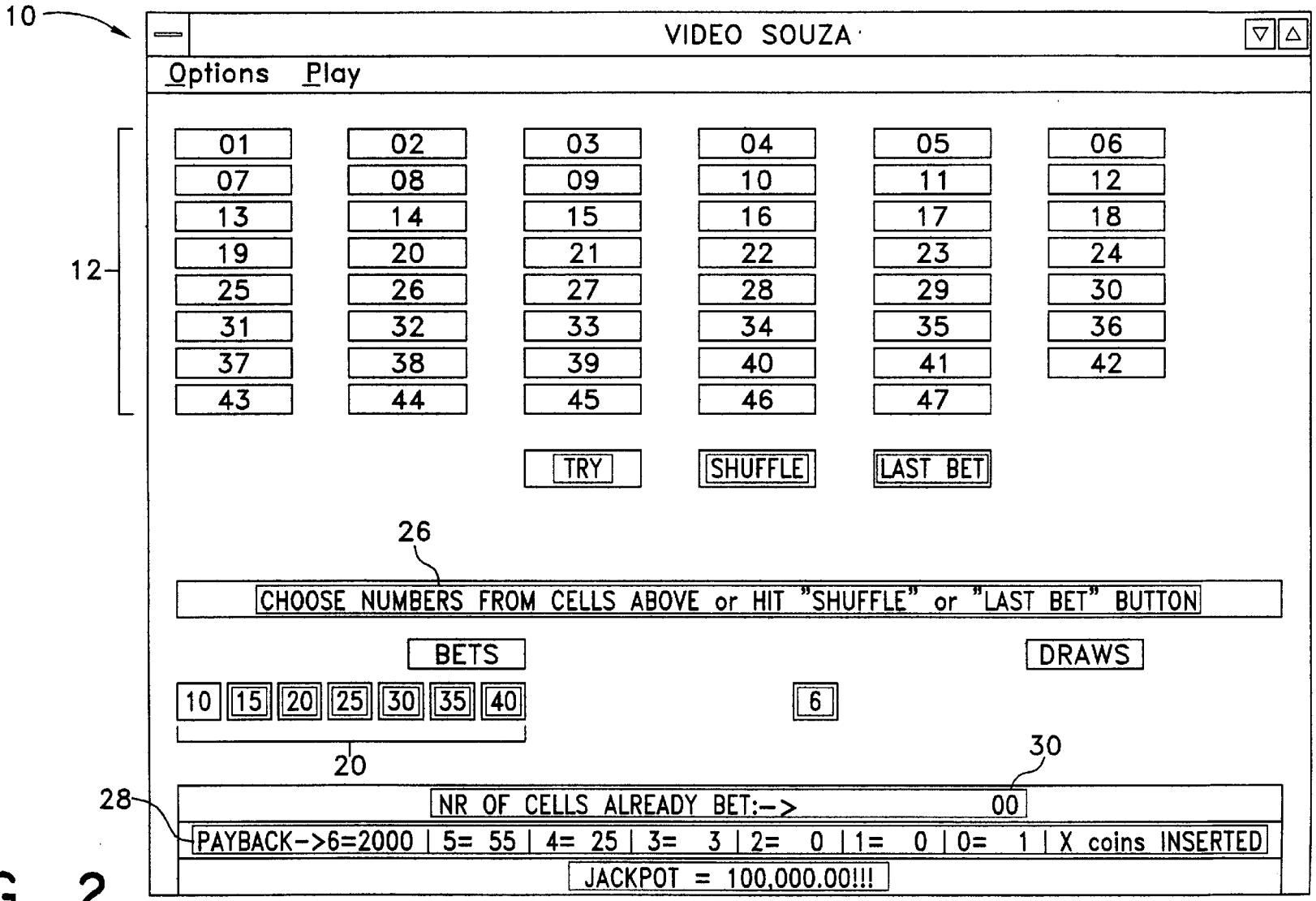
FIG. 2 is a screen print similar to FIG. 1 illustrating the screen of the preferred embodiment after the number of bets have been selected.

Turning now to FIG. 2, there is represented the first step in playing the preferred embodiment of the game. This step involves selecting the number of wagers that the player will make from among blocks 20. In this case, the player has selected to make 10 wagers by clicking on the leftmost of blocks 20. When he does so, the legend in block 26 invites him to makes this selections from among blocks 12, select "shuffle" or "last bet." At the same time, block 28 indicates the payouts at block 28. In the preferred embodiment, it is assumed that the player will insert coins to play the game and block 28 indicates the ratio between the payout and wagered amount for each number of matches. For example, if the player matches all 6 selections by the computer, he will receive 2,000 times his wager, if he matches no selections made by the computer, the payout equals his wager, and if he matches one or two numbers selected by the computer, he loses. As the user selects blocks or cells from among blocks 12, block 30 indicates the number of cells already selected.

Figure 3:
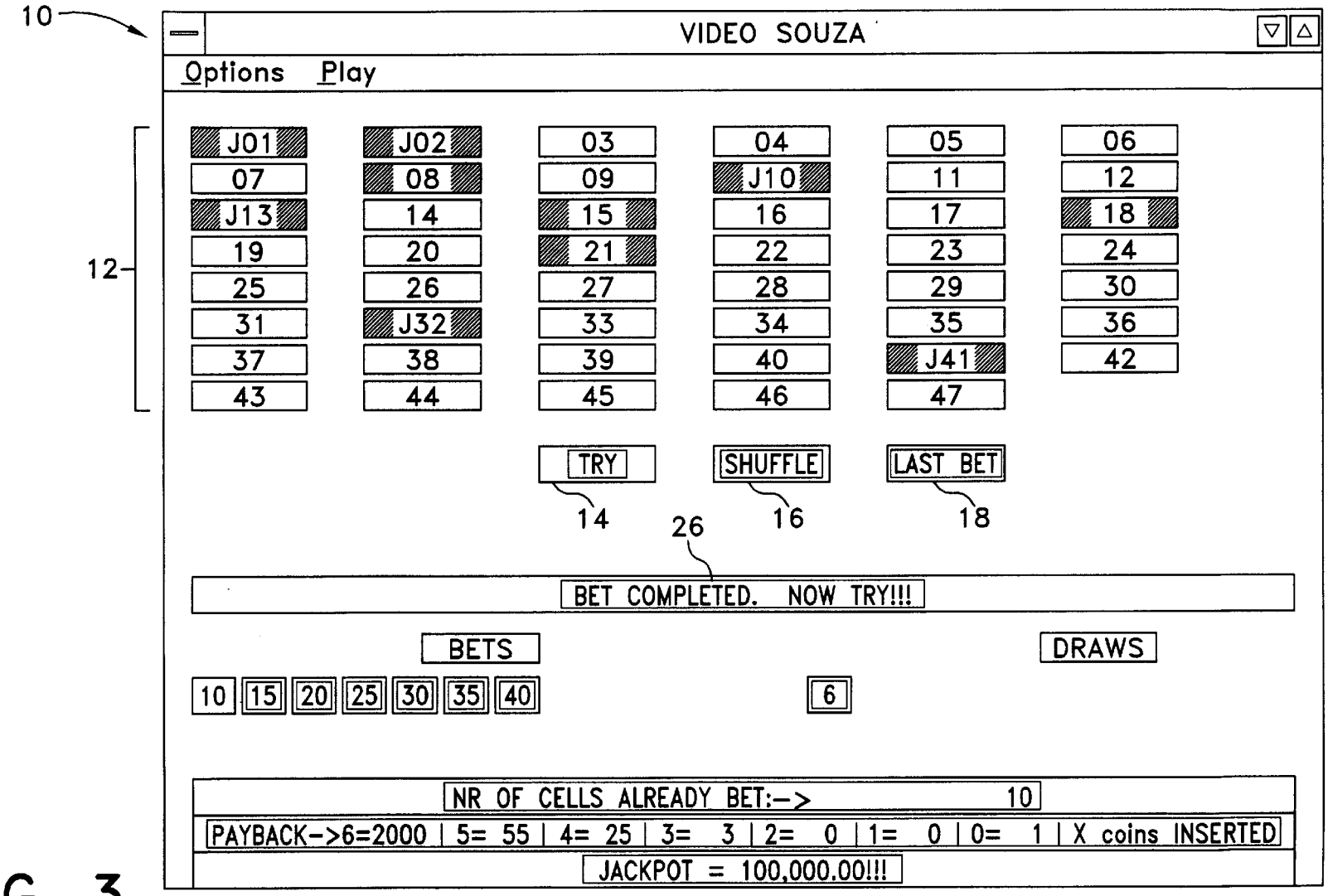
FIG. 3 is a screen print similar to FIG. 1 illustrating the screen of the preferred embodiment after the player has selected his bets.

FIG. 3 illustrates the condition of screen 10 after the player has made all of his selections (in this case 10) by one of the three methods: selecting individual cells among blocks 12; clicking on block 16 to have ten selections made for him automatically; or clicking on block 18 to repeat his last bet. As the player makes his selections, the computer indicates six of his cell selections with a "J" to indicate that those cells are to be considered for the jackpot (i.e. if the cells containing the "J" are later drawn by the computer, he wins the jackpot). This not only adds to the excitement, but the player is able to see how close he has come to a jackpot. After the appropriate number of cells have been selected from blocks 12, block 26 informs the player that the bet is completed and invites him to click on block 14.

Figure 4:
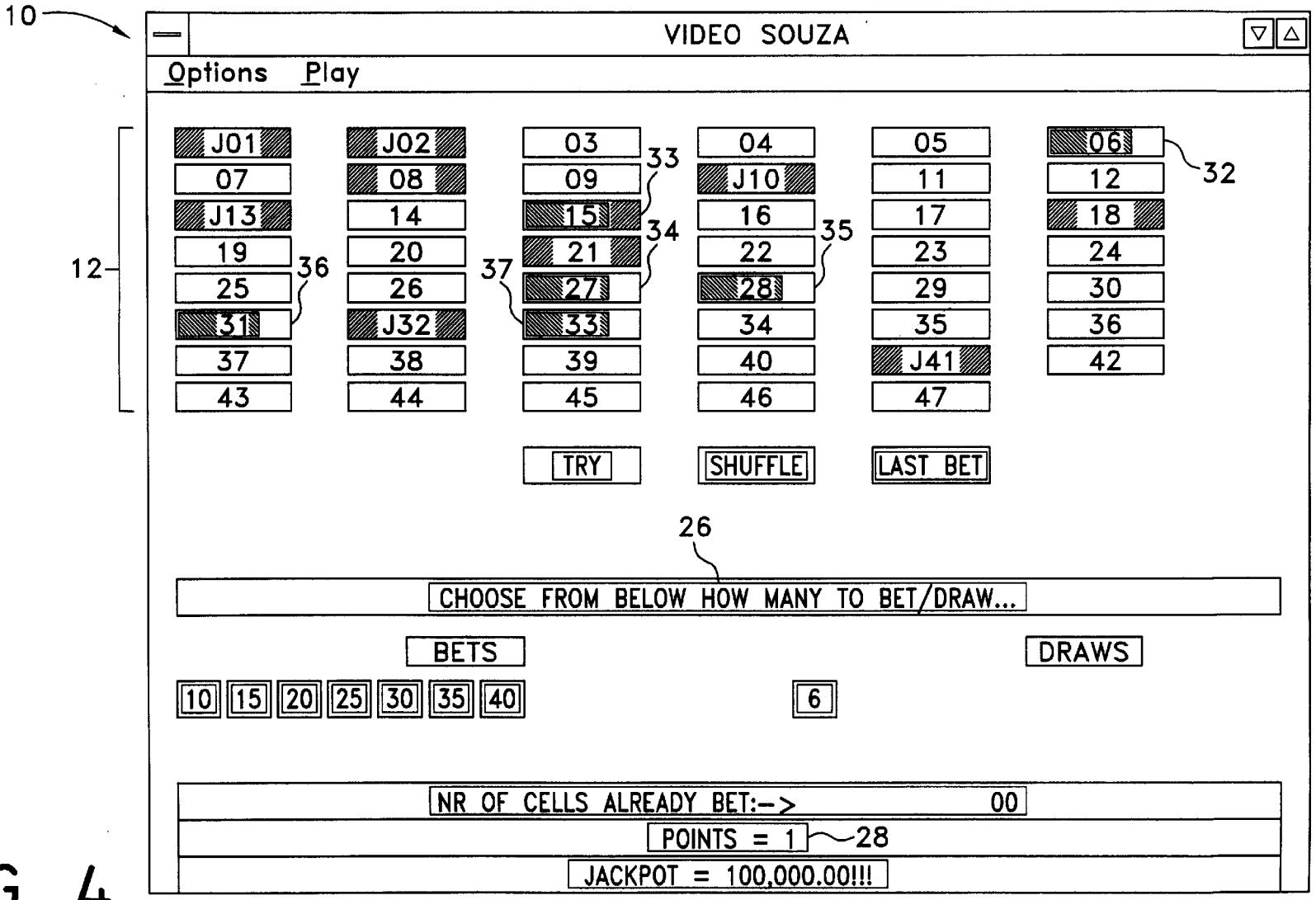
FIG. 4 is a screen print similar to FIG. 1 illustrating the screen of the preferred embodiment after the computer on which the game is run has selected its draws, determined the number matches between the bets and draws, and also whether a payout is due.

After the player clicks on block 14, the computer will select its blocks ("draws") at random. For dramatic effect, it scrolls past the blocks 12 in sequence, selecting one at a time. This adds to the excitement of the game, in that the player is able to see matches as they occur and is held in suspense for a period of time before he knows whether he will receive a payout. FIG. 4 illustrates screen 10 after the computer has made its selections 32–37 from among blocks 12. After this selection is completed, block 28 informs the player of the number of matches or "points" which he has made and the payout that he will receive, if any. In FIG. 4, the player has made only one match, so he receives no payout. Block 26 then invites the player to choose a number of cells to wager in his next game.

Figure 5:
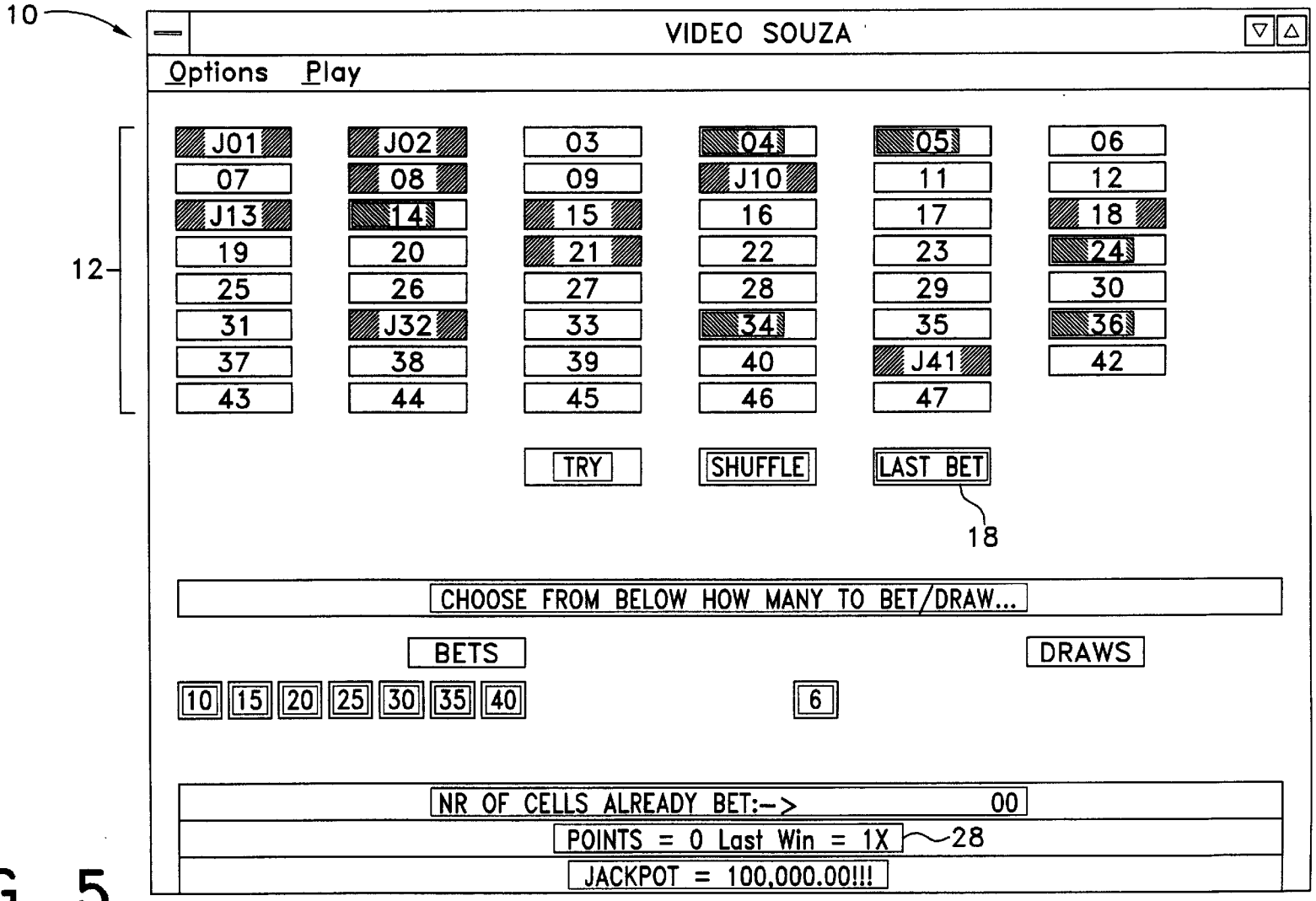
FIG. 5 is a screen print similar to FIG. 4 illustrating the screen of the preferred embodiment after the player has repeated his last bet, the machine having selected its draws, has determined the number of matches, and has also determined the payout.

FIG. 5 shows screen 10 after the player has made his next wager. In this case, he has once more selected to make 10 wagers and has repeated his last selection from among blocks 12 by clicking on block 18. In this case, the computer has selected none of the numbers that the user selected. In the absence of a match, the user is returned his wager as a payout, and the block 28 so indicates.

In block 28 of FIG. 2, there was indicated the payout when the player selected to make 10 wagers. Table 1 indicates the payout schedule with respect to each number of bets for the preferred embodiment. It will be appreciated by varying the number of wagers he will make, the player is able to affect the frequency of payouts and the excitement of the game.

TABLE 1

PAYOUT RATE SCHEDULE

| | No. of Bets | | | | | | |
|---|---|---|---|---|---|---|---|
| No. Matches | 10 | 15 | 20 | 25 | 30 | 35 | 40 |
| 0 | 1 | 1 | 4 | 7 | 11 | 220 | 10,000 |
| 1 | 0 | 0 | 2 | 2 | 5 | 16 | 130 |
| 2 | 0 | 0 | 0 | 0 | 3 | 6 | 12 |
| 3 | 3 | 2 | 0 | 0 | 0 | 0 | 4 |
| 4 | 25 | 3 | 1 | 1 | 0 | 0 | 0 |
| 5 | 55 | 14 | 5 | 2 | 1 | 1 | 0 |
| 6 | 2,000 | 150 | 35 | 14 | 5 | 2 | 2 |

Table 2 demonstrates how the payouts in the "10" column of Table 1 were derived. The system operator has a certain amount of flexibility in creating the payout rates.

TABLE 2

| No. Matches | Win Frequency (%) | Payout Rate | Payout Percentage |
|---|---|---|---|
| 6 | .002 | 2,000 | 4.000 |
| 5 | .087 | 55 | 4.785 |
| 4 | 1.302 | 25 | 32.56 |
| 3 | 8.683 | 3 | 26.05 |
| 0 | 21.650 | 1 | 21.65 |
| Jackpot | $9.3 \times 10^{-8}$ | 100,000 | .93 |
| Total | 31.72% | | 89.99% |

In the first (lefthand) column of Table 2, the matches for which payouts are to be made have been selected. In the second column, the frequency of occurrence of each number of matches is indicated. As can be seen in Table 2, the matches for which payouts are to be made were selected to provide a payout frequency in excess of 30% (31.72%). This should lend interest to the game and give the impression that winning is relatively easy. The payout rate was then selected for each type of match to provide a total payout percentage of approximately 90% (i.e. 10% profit for the house). In each case, the payout percentage for each type of match (the right-hand column in Table 2 is derived by multiplying the win frequency for that type of match by the payout rate. The sum of the pay percentages for the different types of winning matches is then computed at the bottom of the right-hand column. This indicates the total percentage of game proceeds which is paid out to players.

As a further example, Table 3 illustrates how, with approximately the same win frequency (31.72%), the payout rates can be adjusted to yield a payout percentage of only approximately 80%.

TABLE 3

| No. Matches | Win Frequency (%) | Payout Rate | Payout Percentage |
|---|---|---|---|
| 6 | .002 | 2,000 | 4.00 |
| 5 | .087 | 45 | 3.92 |
| 4 | 1.302 | 18 | 23.44 |
| 3 | 8.683 | 3 | 26.05 |
| 0 | 21.650 | 1 | 21.65 |
| Jackpot | $9.3 \times 10^{-8}$ | 100,000 | .93 |
| Total | 31.72% | | 79.99% |

Using the same approach as in Tables 2 and 3, it can be shown that the right-hand column of Table 1 yields a total win frequency of 39.22% and a total payout percentage of 90.01%. As a demonstration of the sort of flexibility available to the operator of the game, a further alternative payout scheme is shown Table 4, according to which the operator of the game is able to maintain the same total payout percent, while providing a total win frequency of nearly 60% (57.09%), which will offer the impression to the player that this game is very easy to win, while at the same time it appears that he has the potential to win substantially large payoffs. At the same time, the total payout percentages are essentially identical.

TABLE 4

| No. Matches | Win Frequency (%) | Payout Rate | Payout Percentage |
|---|---|---|---|
| 6 | 35.75 | 1 | 35.75 |
| 4 | 17.87 | 2 | 35.75 |
| 3 | 3.22 | 4 | 12.88 |
| 2 | 0.25 | 12 | 3.05 |
| 1 | .008 | 130 | 1.01 |
| 0 | $6.5 \times 10^{-6}$ | 10,000 | 6.5 |
| Jackpot | $9.3 \times 10^{-8}$ | 100,000 | .93 |
| Total | 57.09% | | 90.02% |

Figure 6A:
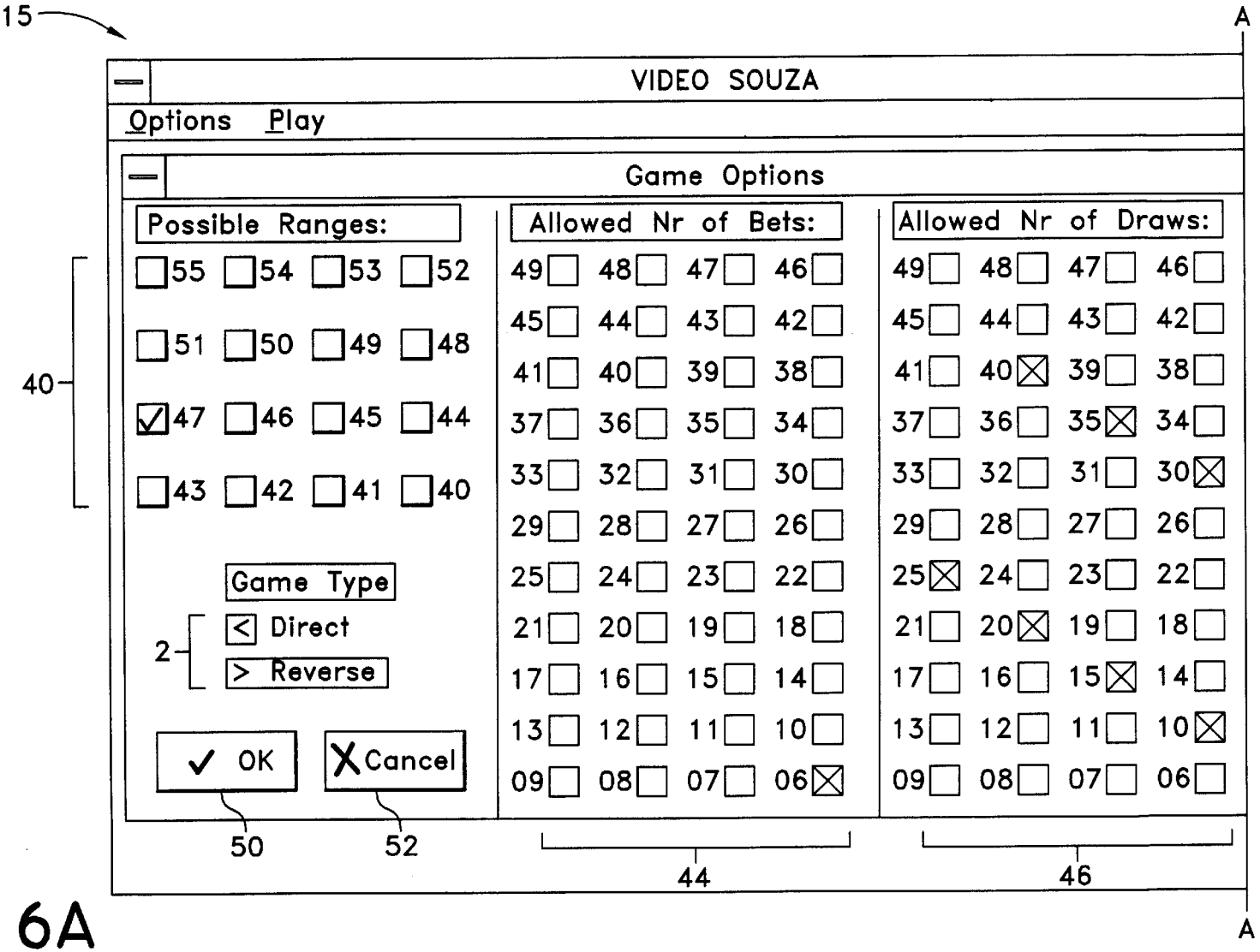
FIG. 6, which comprises FIG. 6A and FIG. 6B placed side-by-side with FIG. 6A to the left, is a gray scale print of the screen obtained when the "Options" selection is made in the menu in the upper left-hand corner of the screen.
Figure 6B:
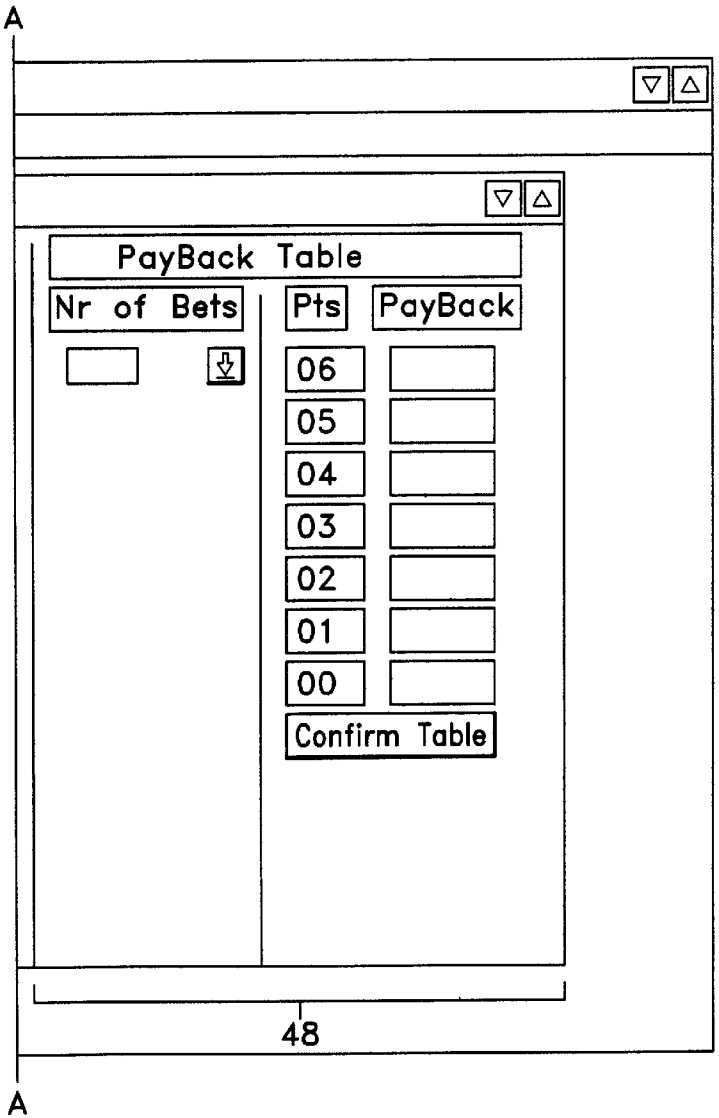

FIG. 6 illustrates the screen that is produced when the "options" selection is made in the system operator's version of the preferred embodiment. This produces the game options screen 15. By clicking on one of the blocks 40 in the upper left-hand corner of screen 15, the operator is able to select the total number of codes used by the game. In the illustrative embodiment, 47 codes have been selected. Immediately below, the operator is able to select a direct or reverse game by clicking on one of two radio buttons 42. All of the screens discussed up to this point represent a direct game. A reverse game will be discussed below.

Near the middle of screen 15, the operator is presented with a choice of forty-five check boxes 44, which the operator will check to indicate the choices of the number of bets to be made a available to the player. In a direct game, the operator will be permitted to check a plurality of these boxes by clicking on them. In a reverse game, he will only be able to select one. In the illustrative embodiment, a reverse game has been selected, so the operator has selected only a single one of the check boxes 44. To the left of boxes 44, the operator is provided with a selection of forty-five check boxes 46. In a direct game, he may only select one of these boxes, whereas in a reverse game, he is permitted to select a plurality of them. In the illustrative embodiment, the operator has selected 7 of boxes 46 corresponding to the numbers "10", "15", "20", "25", "30", "35" and "40." Accordingly, in the game corresponding to screen 15, the player will be able to select the number of draws of code words made by the computer, and those selections will correspond to either 10, 15, 20, 25, 30, 35 or 40 draws. In the right-hand portion of screen 15, the operator is presented with seven fill-in boxes 48. By making use of these boxes, the operator is able to control the payment ratio of the each number of matches ("points").

Once the operator has checked off and/or filled in screen 15 as he desires, he may save the results by clicking on block 50. Alternatively, the operator may decide not to save the modified options by clicking on block 52.

Figure 7:
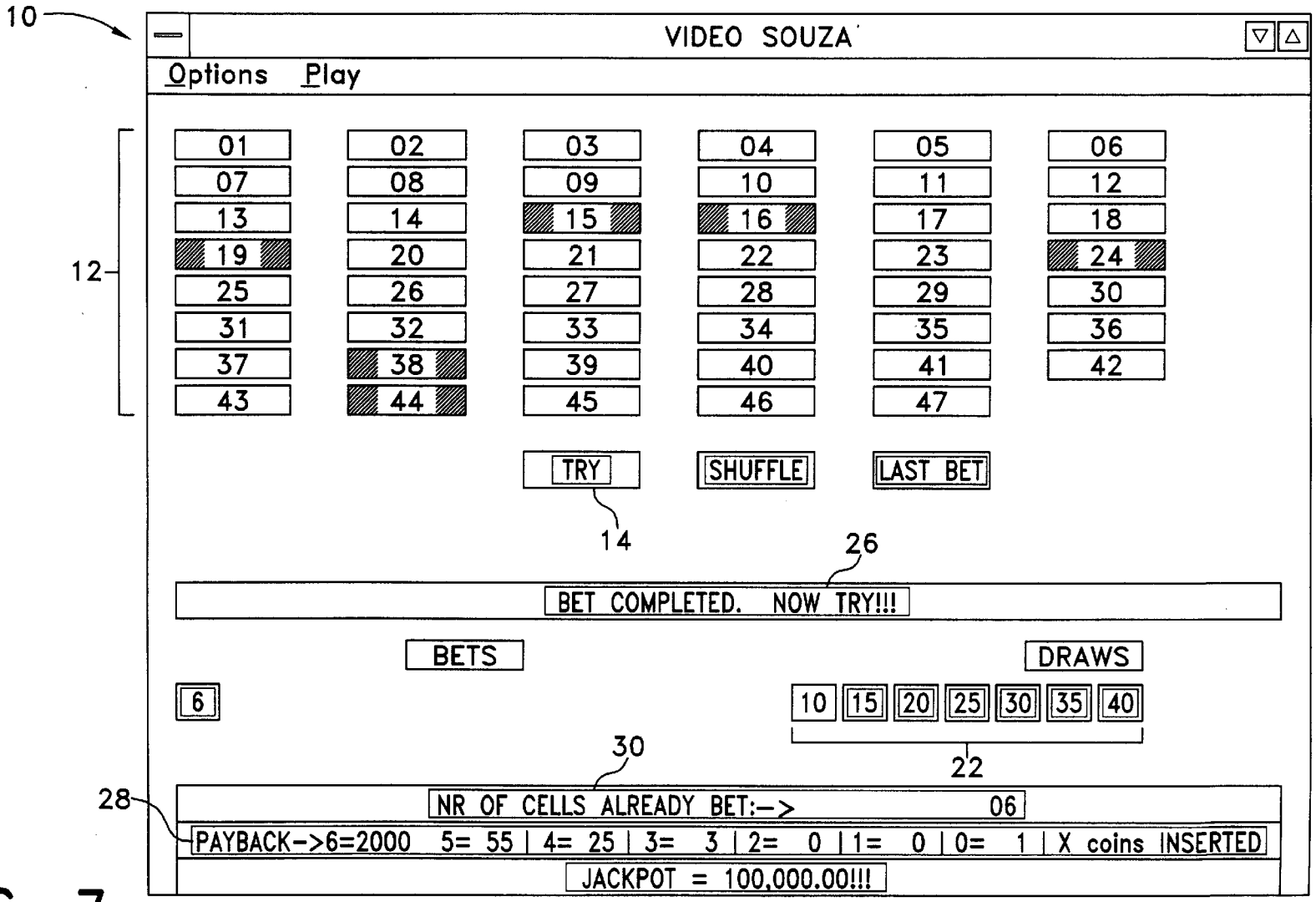
FIG. 7 is a screen print similar to FIG. 1 illustrating the screen of an alternate embodiment of the game of the invention, in this case a "reverse" game, after the player has selected his bets.
Figure 8:
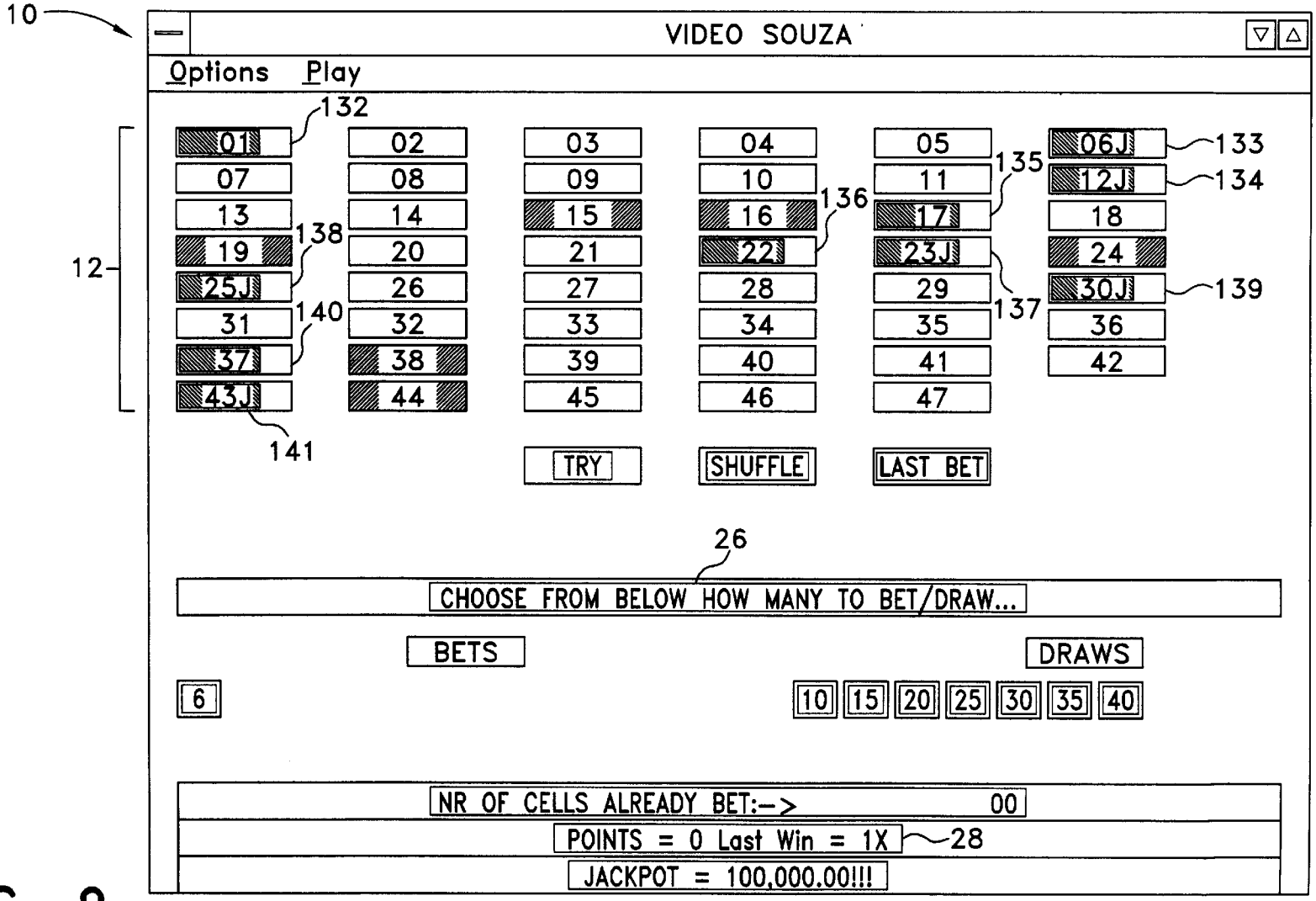
FIG. 8 is a screen print of the game screen of FIG. 7 after the machine has selected its draws, determined the number of matches, and also determined the payout.

FIGS. 7 and 8 illustrate the reverse game corresponding to the game options screen 15 of FIG. 6. Since the operator has not filled in the blocks 48 of the payback table of screen 15, the game utilizes built-in default values corresponding to the game of FIGS. 1–5.

Since a reverse game with 47 code words has been selected, the player is presented with a choice of 7 different size draws to be made by the computer at blocks 22. He is also informed at block 20 that he is permitted to chose 6 of blocks 12, and a message in block 26 invites him to choose that number of bets from among blocks 22 (see FIG. 8). As explained above, the user may also select a "SHUFFLE" or may repeat his "LAST BET." In a reverse game, the player will win a jackpot if the fist six numbers drawn by the computer match his bet. After the player selects the number of draws to be made by the computer (ten have been selected in FIG. 7). In any event, after the user has selected the number of draws, he is presented with a payback table at block 28. As illustrated in FIG. 7, the user has already made 6 wagers and is invited by block 26 to click on block 14.

Once the player clicks on block 14, the computer will sequence through blocks 12, making the number of draws indicated in box 22. As illustrated in FIG. 8, the computer has drawn or selected from among blocks 12 the blocks 132–141. The player is able to watch the progression of these selections in a state of suspense, as his "fate" is determined. Should a number of matches be created which warrant a payout, the computer flashes a colorful announcement screen (not shown) and sounds a audible alarm. This also adds to the excitement. The results of the last draw are then displayed in block 28. In the illustrative embodiment, block 28 indicates that the last draw by the computer resulted in no matches or "points" and the player is therefore entitled to a payout equal to the amount of his wager.

From the foregoing description, it will be appreciated that the present invention achieves all of the desirable characteristics of a game of chance. The operation is simplicity itself. At the same time, the game offers a huge jackpot (a payback rate of 100,000, while the system operator has the flexibility to vary the win frequency over a wide range, even to make it more frequent than a coin toss (approximately 60%). The game offers emotional excitement and suspense in the way it presents the computer's choices to the player and then reports wins and payouts. Finally, in displaying the actual computer selections simultaneously with the player's selections, it gives the impression in every instance that a player's failure to win was a near miss. These advantages are combined with a high degree of flexibility offered to the system operator in controlling win rate and total payout percentage independently.

Assuming that the game were played by a multiplicity of computers on a network, further excitement could be added by having an accumulating jackpot. For example the jackpot could start at a nominal value and grow as the cumulative number of bets increases since the last jackpot was won. When a jackpot is finally awarded, the accumulation process would restart with the nominal value.

Figure 9:
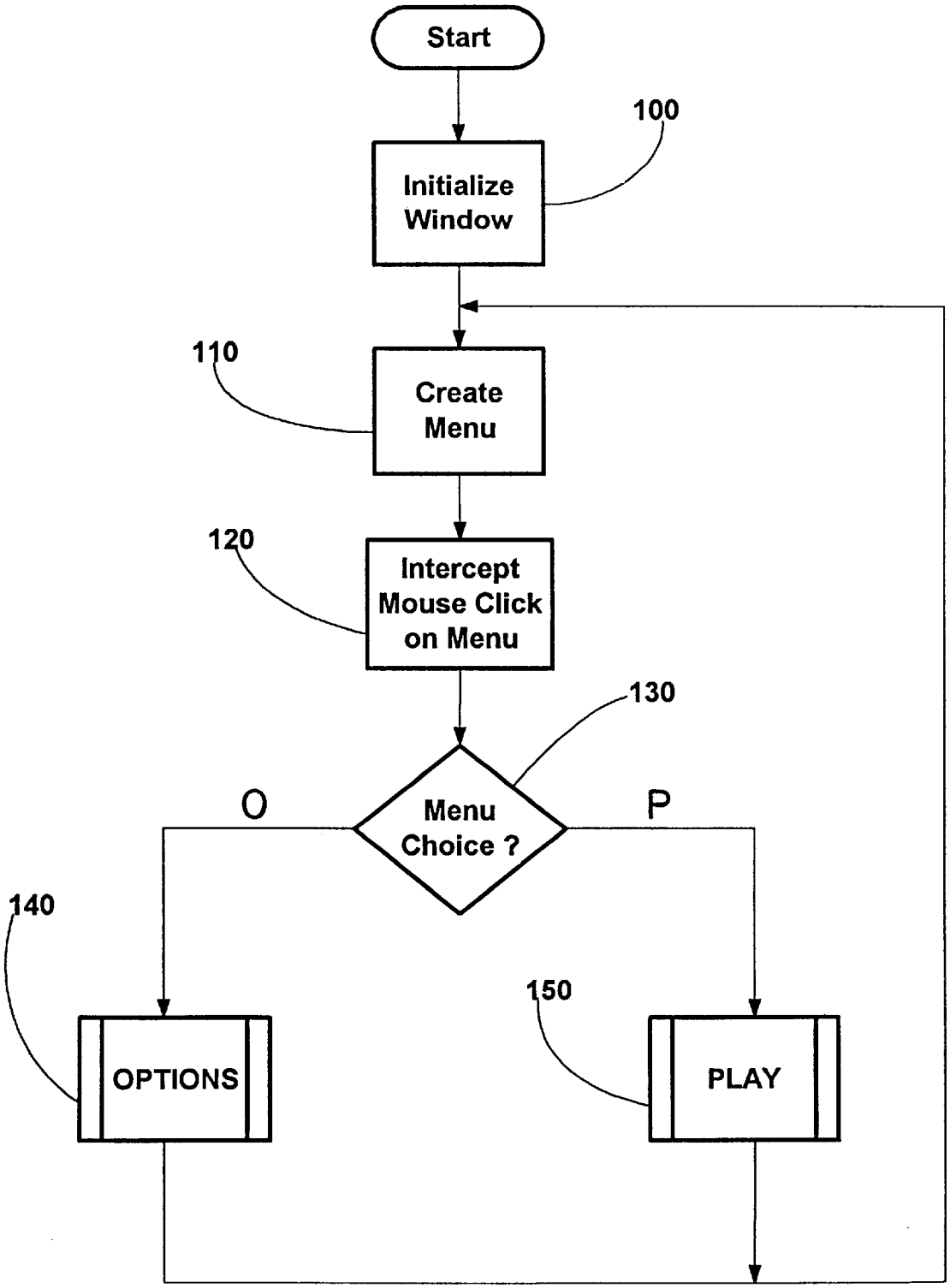
FIG. 9 is a flowchart illustrating the operation of the preferred embodiment of the invention when selections are made in the menu in the upper left-hand corner of the screen.

FIG. 9 is a flowchart which illustrates the method of operation of the preferred embodiment of the program when operated by the system operator. At block 100, the window of the program is initialized and, at block 110, the menu in the upper left-hand corner of the window is created. At block 120, the program intercepts mouse clicks on the menu, then, at block 130, a determination is made whether the mouse click was on the "Options" choice or the "Play" choice. If the "Options" choice was made, control is transferred to the "Options" screen and the associated subprogram at block 140. On the other hand, if the "Play" choice was made, control is transferred to the "Play" screen and the associated subprogram at block 150. When either the subprograms is completed, control reverts to block 110.

Figure 10:
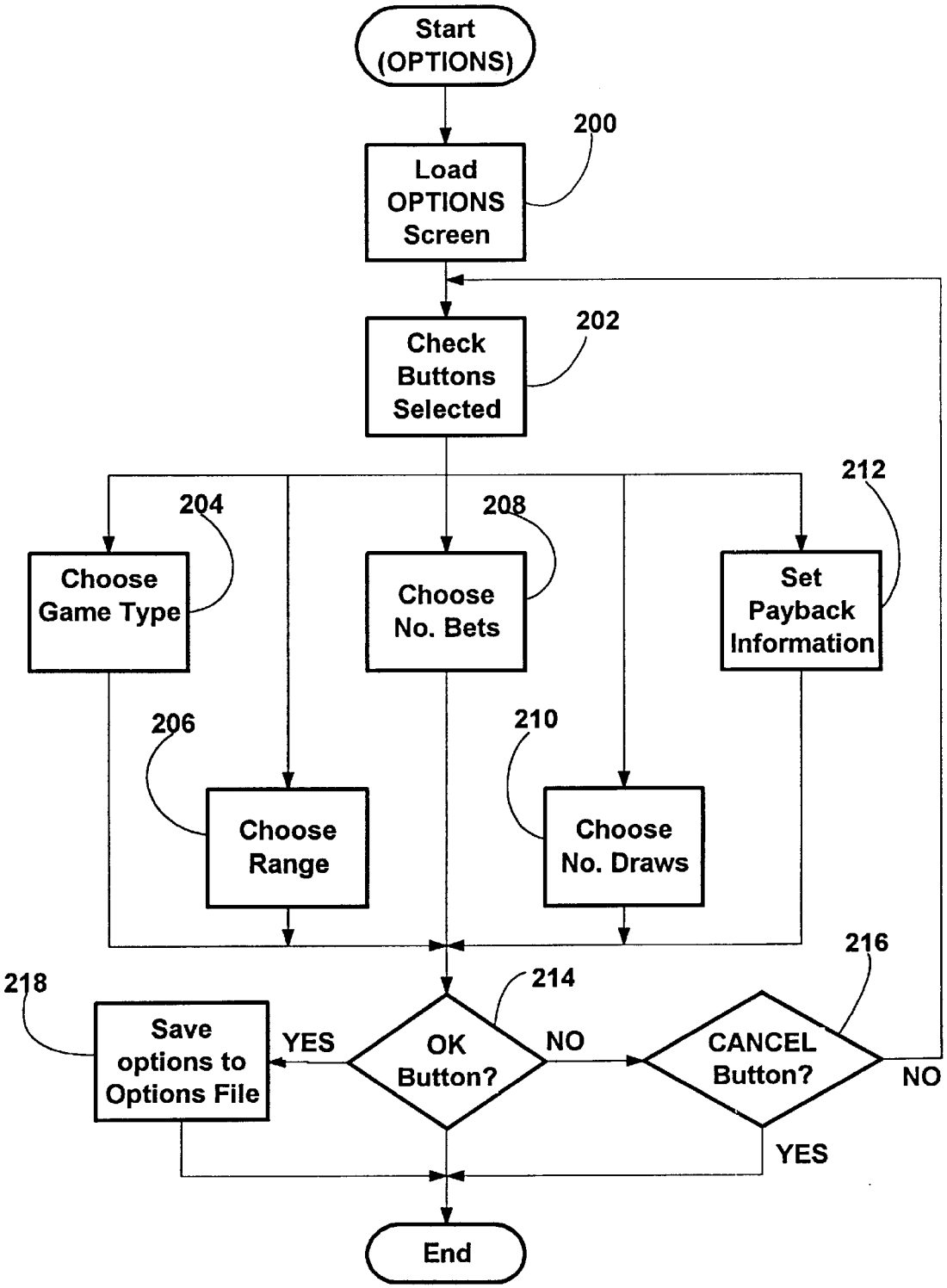
FIG. 10 is a flowchart illustrating the operation of the preferred embodiment after the OPTIONS choice has been made in the menu.

FIG. 10 is a flowchart illustrating the operation of the OPTIONS subprogram of the present invention. After initiation of the subprogram, the options screen is loaded at block 200. At block 202, the program checks the button selected by the operator's mouse clicks. If the button was one of the "Game Type" buttons 42, the selected game type is chosen, if the button was one of the range buttons 40 (i.e. those relating to the number of code words), then the appropriate range is selected. On the other hand, if the button was one of those related to the number of bets (buttons 44), or the number of draws (buttons 46), then the corresponding number of bets or draws is chosen. Should the system operator have entered of information in the payback blocks 48, the payback information input by the operator is set at block 212. At block 214, a test is performed to determine whether or not the operator has clicked the OKAY button. If not, control is transferred back to block 202, assuming that the operator has not pressed the CANCEL button (test performed at block 216). On the other hand, had the CANCEL button been selected, the subprogram terminates immediately. Should the test at block 214 have indicated that the OKAY button was selected, the options selected by the operator are saved to an options file, and the subprogram terminates.

Those skilled in the art will appreciate that, although the preferred embodiments of the present invention have been described as a casino video game, the same game could readily be provided as a home video game, possibly with an on-line connection to a gaming center. The invention could also be embodied in the well-known form of a lottery game in which the players make their selections on cards that they purchase which are then read into an appropriate card scanner.

Figure 11A:
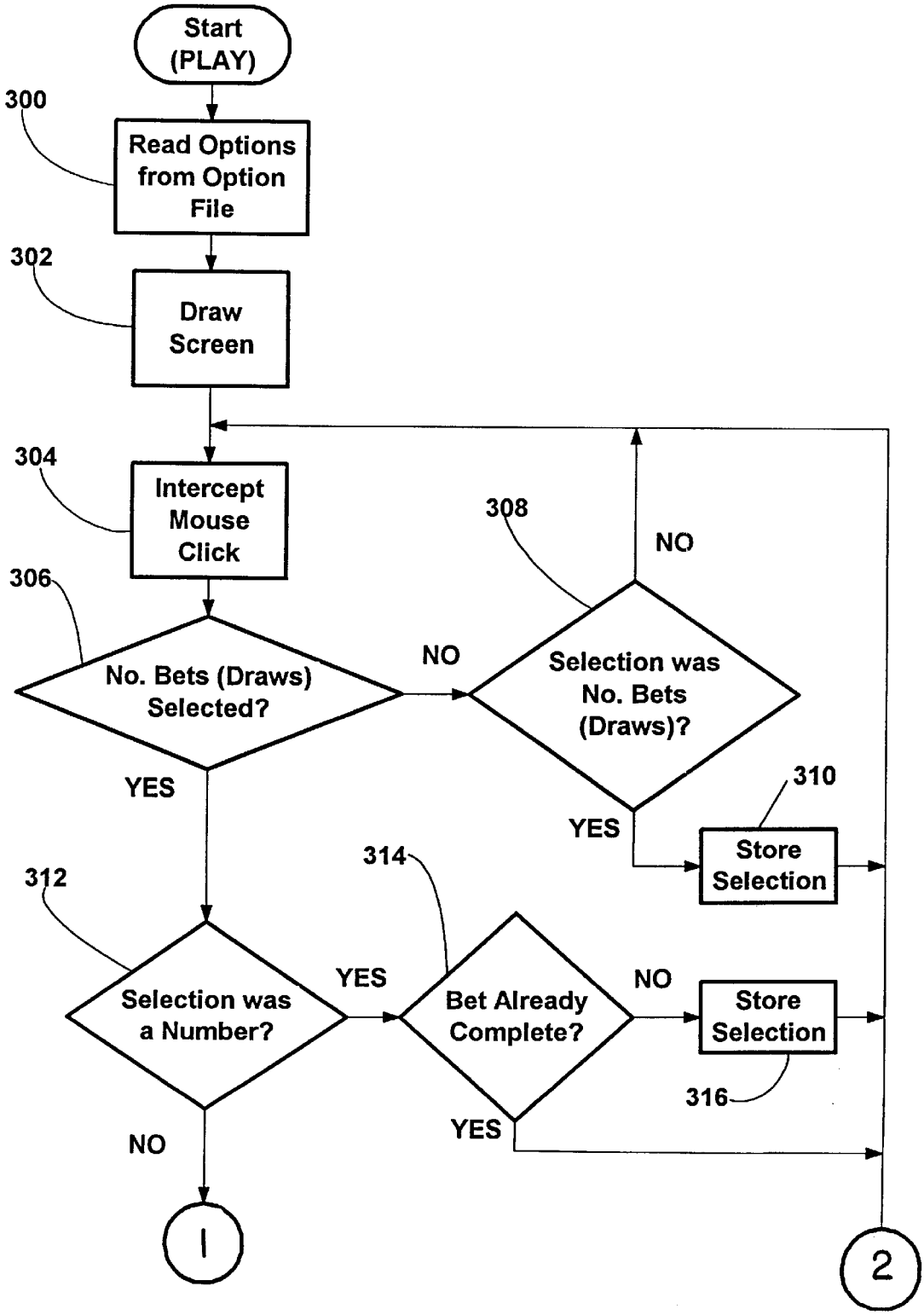
FIGS. 11A–11C constitute a flowchart illustrating the operation of the preferred embodiment when the PLAY selection has been made in the menu in the upper left-hand corner of the screen.
Figure 11B:
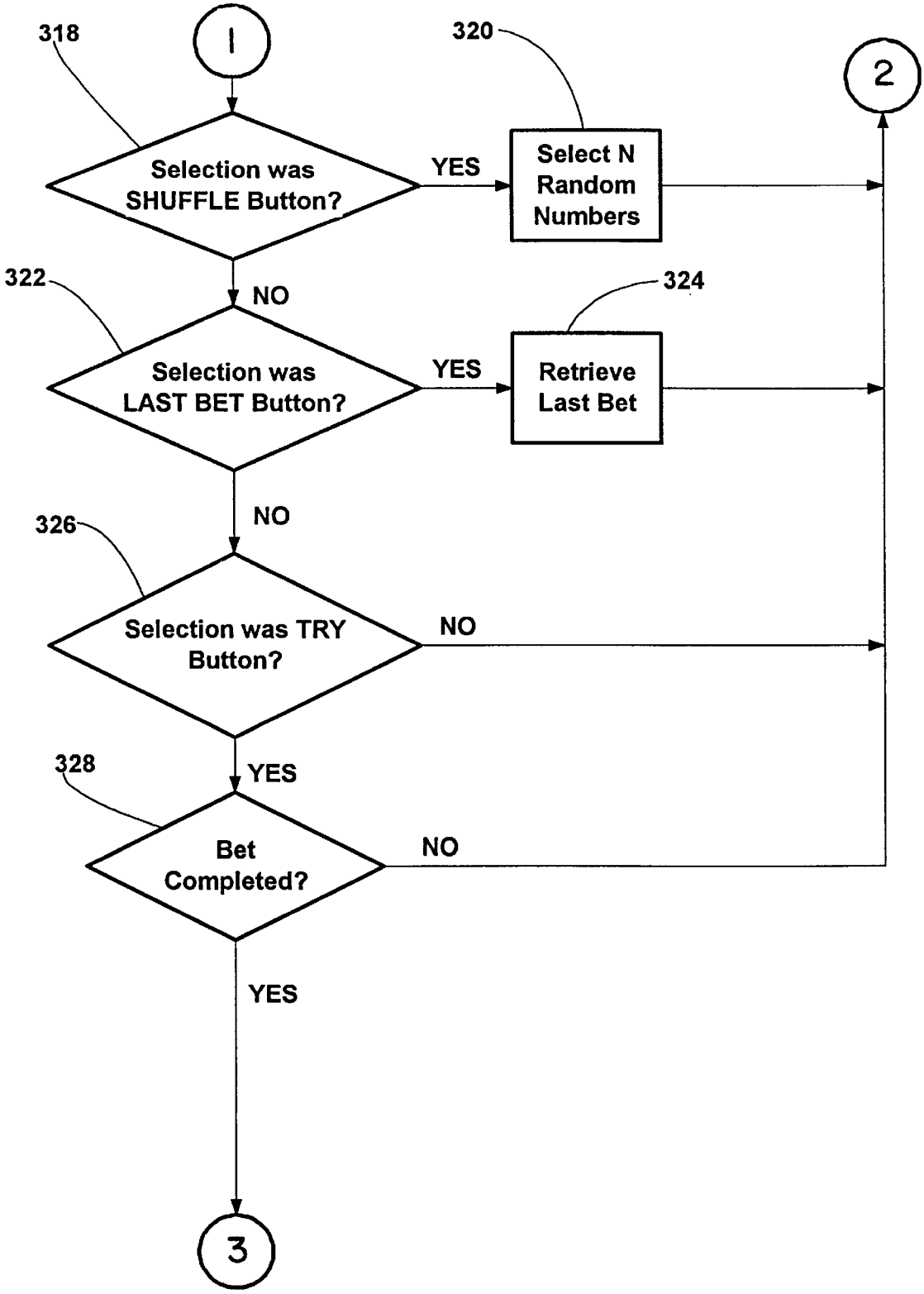
Figure 11C:
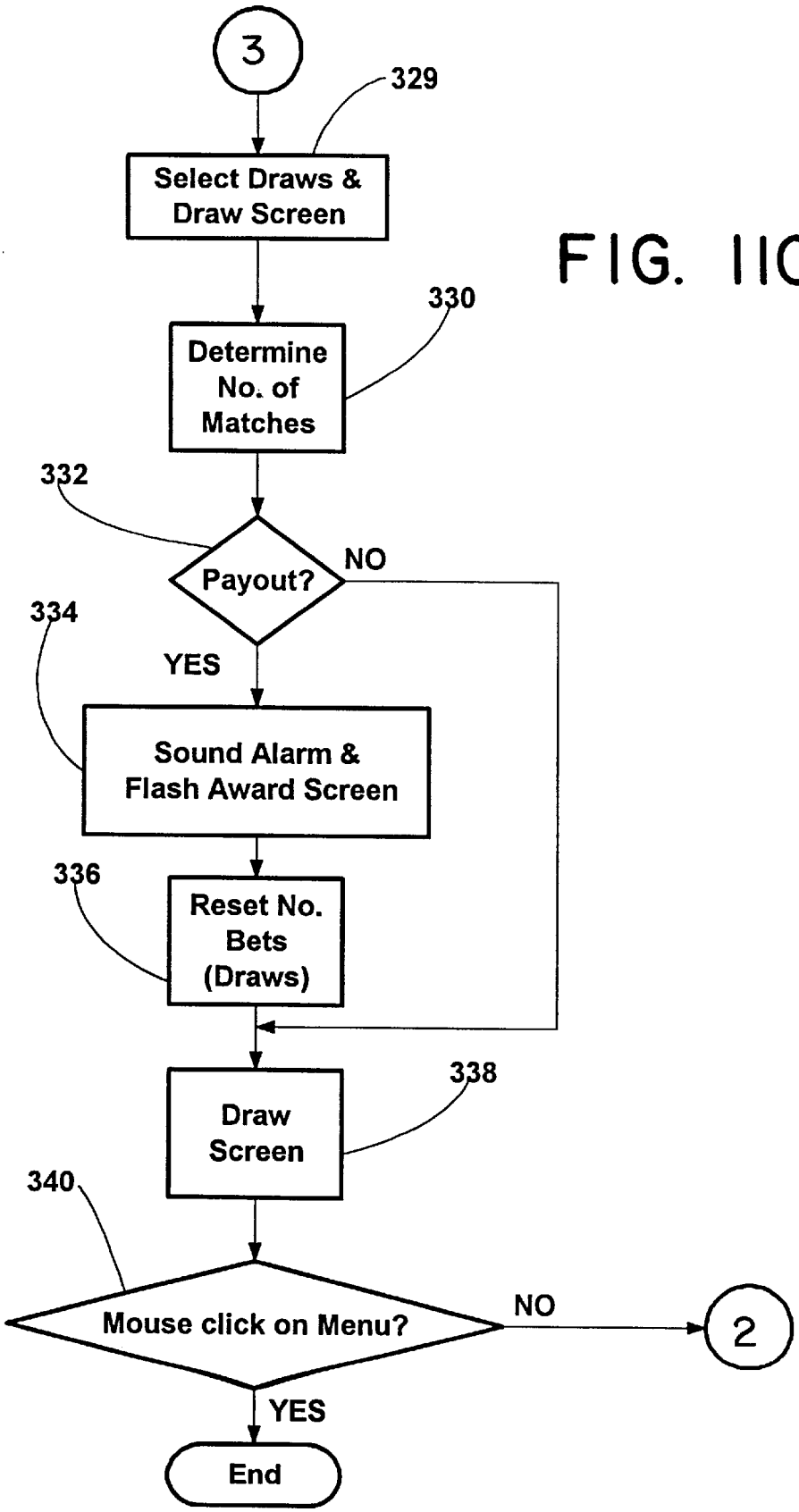

FIGS. 11-A through 11-C constitute a flowchart illustrating how the PLAY subprogram operates. It will be recalled that only the system operator gets the full program in the preferred embodiment. The PLAY subprogram is, in fact, the only program to which a player has access.

After the program is initiated, the options set by the system operator are read from the option file at block 300, in order to configure the program and draw the initial screen at block 302. At block 304, the program intercepts mouse clicks occurring on screen 10. At block 306, the program performs a test to determine whether or not the player has yet selected the number of bets that he will place. On the other hand, if the player were playing a reverse game, he would be selecting the number of draws to be made by the machine so, the word "draws" is shown in parentheses to illustrate this alternative. Assuming that the player has not yet selected the number of bets, a test is made at block 308 to determine whether or not the selection on which the player clicked was the number of bets (draws). If not, control is returned to block 304 to await the next mouse click. It will be appreciated that the program will proceed no further until the player has selected the number of bets (draws). However, once that selection has been made, the test at block 308 will cause the selection to be stored at block 310, and control will be returned to block 304 to await another mouse click.

On the other hand, if the test at block 306 determines that the number of bets (draws) has been selected, control is transferred to block 312, where it is determined whether or not the players selection was a code (number). if the selection was a number, a test is performed at block 314 to determine if the number of selections needed to complete the bet has previously been made and, if so, control is returned to block 304 to await another mouse click. If the bet has not been completed, the number selected is stored at block 316, the screen display is updated, and control is returned to block 304.

Should the test at block 312 determine that the selection was not a number, control is transferred to block 318, where a test is performed to determine whether or not the player's selection was the SHUFFLE button. If so, the machine selects N random numbers at block 20 as the player's bet, where N is the number of codes he selected; the screen display is also updated, and control is returned to block 304 to await another mouse click.

Should the test at block 318 determine that the player's selection was not the SHUFFLE button, control is transferred to block 322, where a test is performed to determine whether the player's selection was the LAST BET button. If so, control is transferred to block 324, where the last bet is retrieved and the display is updated. Control is then transferred to block 304 to await another mouse click.

Should the test at block 322 determine that the player's selection was not the LAST BET button, control is transferred to block 324, where a test is performed to determine whether the player's selection was the TRY button and, if not, control is returned to block 304 to await another mouse click. If the player's selection was the TRY button, a test is performed at block 326 to determine whether or not the player has selected a sufficient number of codes to complete the bet. If not, control is returned to block 304 to await further mouse clicks representing additional bets and an appropriate message is delivered to the screen. On the other hand, if the test at block 328 determines that the bet has been completed, control is transferred to block 329, where the machine selects its draws, simultaneously updating the screen.

At block 330, the machine then determines the number of matches between the bets and draws and calculates the appropriate payout ratio. At block 332, a test is performed to determine whether or not the player is entitled to a payout and, if not, control is transferred to block 338. If the player is entitled to a payout, block 334 causes an alarm to sound and flashes a screen announcing the award of a payout. The number of bets (draws) is then reset to zero at block 336 and the screen is redrawn at block 338. A test is then performed at block 340 to determine whether or not a mouse click has been made on the menu appearing in the upper left hand corner of the screen (available to system operator only) and, if so, the subprogram is terminated. If no mouse click has been made on the menu in the upper left hand corner (or if the program is being operated by a player, control returns to block 304 to await another mouse click on screen 10.

What is claimed is:

1. A game of chance, comprising:

a source of a library of codes;

a selector controlled by a player, the selector being operated to select the number of wagers and a number of specific codes of said library equal to the number of wagers;

a system operator's console including means for independently selecting at least one of:

the particular number of matches between player selected codes and game selected codes that will constitute a win and the payment awarded for each type of win;

the frequency of occurrence of different numbers of such matches; and the total payment rate of the game;

a computer based controller responsive to the selector and the console for selecting a predetermined number of game selected codes randomly selected by the controller, determining matches between player selected and game selected codes and computing player payments based upon system operator input; and means for displaying the player selected codes, the computer selected codes, the number of wins and the payment awarded by the game.

2. The game of claim 1, wherein said controller awards payment for the failure to produce any match, in relationship to the likelihood of its occurrence.

3. The game of claim 2, wherein said selector includes means operable by a player for selecting a random set of codes equal to the number of wagers.

4. The game of claim 3, wherein said selector includes means operable by a player for re-selecting a group of codes previously selected by the player.

5. The game of claim 4 further comprising means in said controller for randomly selecting a second predetermined number of the player selections for inclusions in a bonus pool, a bonus being paid to the player in the event that the player selections in the bonus pool match controller selections.

6. The game of claim 1, wherein said selector includes means operable by a player to selecting a random set of codes equal to the number of wagers.

7. The game of claim 1, wherein said selector includes means operable by a player for re-selecting a group of codes previously selected by the player.

8. The game of claim 1 further comprises means in said controller for randomly selecting a second predetermined number of the player selections for inclusions in a bonus pool, a bonus being paid to the player in the event that the player selections in the bonus pool match controller selections.

9. The game of claim 1 wherein the player is constrained to selecting a predetermined number of wagers fixed via the console, but may control via the selector the number of game selected codes.

10. A computer program stored in a storage medium for providing a game of chance, comprising:

a selection program module receiving input from a player for selecting the number of wagers made by the player and a number of specific codes from a predetermined library of codes equal to the number of wagers;

a system program module receiving input from a system operator for independently selecting at least one of:

the particular number of matches between player selected codes and game selected codes that will constitute a win and the payment awarded for each type of win;

the frequency of occurrence of different numbers of such matches; and the total payment rate of the game;

a control program module responsive to the selection and system modules for randomly selecting a predetermined number of game selected codes, determining matches between player selected and game selected codes and computing player payments based on system operator input; and a display program module for displaying the player selected codes, the computer selected codes, the number of wins and the payment awarded by the game.

11. The program of claim 10, wherein said selection module includes a program module responsive to player input for selecting a random set of codes equal to the number of wagers.

12. The program of claim 11, wherein said selection module includes a program module responsive to player input for re-selecting a group of codes previously selected by the player.

13. The program of claim 12 further comprising a program module in said control module for randomly selecting a second predetermined number of the player selections for inclusions in a bonus pool, a bonus being paid to the player in the event that the player selections in the bonus pool match controller selections.

14. The program of claim 10, wherein said selection module includes a program module responsive to player input for re-selecting a group of codes previously selected by the player.

15. The program of claim 10 further comprising a program module in said control module for randomly selecting a second predetermined number of the player selections for inclusions in a bonus pool, a bonus being paid to the player in the event that the player selections in the bonus pool match controller selections.

16. The program of claim 10 wherein the player is constrained to selecting a predetermined number of wagers fixed via the system module, but may control via the selection module the number of game selected codes.

17. A method for playing a computer controlled game of chance game of chance, said game including a source of a library of codes, said method comprising the steps of:

accepting a players input of the number of wagers to be made and a number of specific codes of said library equal to the number of wagers;

receiving a system operator's input of at least one of:

the particular number of matches between player selected codes and game selected codes that will constitute a win and the payment awarded for each type of win;

the frequency of occurrence of different numbers of such matches; and the total payment rate of the game;

controlling said game in response to the player and system operator inputs so as to select a number of game selected codes set by the operator, the actual codes being randomly selected by the game, determining matches between player selected and game selected codes and computing player payments based upon system operator input; and displaying the player selected codes, the computer selected codes, the number of wins and the payment awarded by the game.

18. The method of claim 17, wherein payment is awarded for the failure to produce any match, in relationship to the likelihood of its occurrence.

19. The method of claim 18, wherein said accepting step comprises generating upon instruction from the player a random set of codes equal to the number of wagers.

20. The method of claim 19, wherein said accepting step comprises reusing as the player's wagers a group of codes previously selected by the player as a previous set of wagers.

21. The method of claim 20 further comprising the steps of randomly selecting a second predetermined number of the player selections for inclusions in a bonus pool, a bonus being paid to the player in the event that the player selections in the bonus pool match game selections.

22. The method of claim 17, wherein said accepting step comprises generating upon instruction from the player a random set of codes equal to the number of wagers.

23. The method of claim 17, wherein said accepting step comprises reusing as the player's wagers a group of codes previously selected by the player as a previous set of wagers.

24. The method of claim 17, further comprising the steps of randomly selecting a second predetermined number of the player selections for inclusions in a bonus pool, a bonus being paid to the player in the event that the player selections in the bonus pool match game selections.

25. The method of claim 1 wherein the player is constrained to selecting a predetermined number of wagers fixed via the console, but may control via the selector the number of game selected codes.

* * * * *